US007617637B2

(12) United States Patent
Yates

(10) Patent No.: US 7,617,637 B2
(45) Date of Patent: Nov. 17, 2009

(54) PLAYGROUND ROOF SYSTEM

(75) Inventor: Amy E. Yates, Ft. Payne, AL (US)

(73) Assignee: Playcore, Chattanooga, TN (US)

( * ) Notice: Subject to any disclaimer, the term of this patent is extended or adjusted under 35 U.S.C. 154(b) by 506 days.

(21) Appl. No.: 10/961,106

(22) Filed: Oct. 8, 2004

(65) Prior Publication Data

US 2006/0075692 A1 Apr. 13, 2006

(51) Int. Cl.

| | |
|---|---|
| ***A63B 9/00*** | (2006.01) |
| ***A63G 31/00*** | (2006.01) |
| ***A63H 3/52*** | (2006.01) |
| ***E04B 7/16*** | (2006.01) |
| ***E04H 1/00*** | (2006.01) |
| ***E04H 3/00*** | (2006.01) |

(52) U.S. Cl. ..... 52/66; 52/36.2; 52/79.1; 52/79.6; 446/476; 472/136; 482/35

(58) Field of Classification Search ..... 52/79.1, 52/79.6, 92.1, 57; 446/476; 472/136; 482/35
See application file for complete search history.

(56) References Cited

U.S. PATENT DOCUMENTS

| | | | | |
|---|---|---|---|---|
| 4,910,928 | A * | 3/1990 | Cellar, Jr. | 52/82 |
| 5,496,232 | A * | 3/1996 | Morris et al. | 482/35 |
| 5,706,613 | A * | 1/1998 | Drake et al. | 52/79.1 |
| 5,890,338 | A * | 4/1999 | Rodriguez-Ferre | 52/582.1 |
| 5,896,709 | A * | 4/1999 | Pope | 52/90.1 |
| 6,099,411 | A * | 8/2000 | Van Wagenen | 472/136 |
| 6,108,988 | A * | 8/2000 | Nagelski et al. | 52/187 |
| 6,796,087 | B1 * | 9/2004 | Greene | 52/32 |
| 2004/0002394 | A1 * | 1/2004 | Heipp et al. | 472/136 |

* cited by examiner

*Primary Examiner*—Richard E Chilcot, Jr.
*Assistant Examiner*—Branon C Painter
(74) *Attorney, Agent, or Firm*—Stephen J. Stark; Miller & Martin PLLC

(57) ABSTRACT

A playground roofing system, for use in protecting sections of a playground system, is provided having a support structure and a molded frame structure. The frame structure is molded to appear as the soffits, fascia and gutters of a real roof, and includes an interior perimeter that has means to connect the frame structure to a molded roof section. The molded roof section is designed to provide a theme to the roof and is interchangeable such that different themes can be quickly effected by releasing and removing the first roof section and replacing it with a second, differently themed, roof section. The roofing system is designed to permit the attachment and removal of the roof section from within the interior perimeter of the frame so that an installer need not have to climb above the roof section to install the roof section.

13 Claims, 6 Drawing Sheets

PLAYGROUND ROOF SYSTEM

FIELD OF THE INVENTION

The present invention concerns roofing systems for use on large playground climbing equipment. More particularly the present invention concerns a modular roofing structure that permits the user to have a roof over sections of a play area or feature in playground equipment, the roof being constructed of a frame and an interior roof section that can be changed or modified to change the character of the play area. The modular roof section being attachable from beneath a frame support such that modifications, changes and repairs are simplified and made safer to construct.

BACKGROUND OF THE INVENTION

Large playground equipment has become prevalent both in public playgrounds and in private back yards with sections of the equipment designed to look like forts, castles and houses, among others. Some playground equipment has been made in the same manner that roofing on housing is made, causing complex and expensive construction. Roofing for such playground set ups including the creation of a substructure to hold the roofing in position, the creation of a frame, soffits and fascia and then the installation of a roof thereon. Typically, as in a real roof, the workers are required to place themselves above the structure to create and install the roofing. In situations where the roof has been created at ground level, or has been molded of plastic, and then placed on a frame, the workers have still had to be above and outside of the supporting structure to install the roof.

I have discovered a method of providing a simple support structure, a roof support system and a modular roof design such that a roof can be installed on a playground system. In the present invention, the roof can be installed from within the structure such that the worker never has to place himself above the structure and into jeopardy. Further, the roof is made in modular sections permitting easy installation and removal and re-installation of a different shaped module such that the design and shape of the roof can be changed quickly and easily. The roof further can fit into a theme, such as a Mediterranean theme by having a Spanish-style tile roof, so that different types of playgrounds, fitting different themes can be built quickly and efficiently.

SUMMARY OF THE INVENTION

In accordance with the present invention, a playground roof system having a support structure for holding up a roof in a playground system and a frame structure, having an inner perimeter is provided. The frame structure is attachable to the support structure and a modular roof section is attachable thereto. It will be understood that the support structure can be as simple as four legs, each holding a corner of the frame or can be any of a variety of structures used in playground systems. In a preferred embodiment, attachment of the roof is to the frame is made from within the inner perimeter of the frame structure such that the roof section can be installed onto the frame from below the frame and support structure. In this manner the installer can construct the system without having to climb above the roof, as is typical in prior art playground systems.

The playground roof system of a preferred embodiment of the present invention is molded of plastic and has designs resembling a soffit, fascia and gutters of a roof. In a preferred embodiment the process of making the elements of the roof system, the frame and modular roof, are roto-molded.

In one embodiment, the modular roof section is removably attached such that it can be placed and then removed so that a second modular roof can be installed within the frame. In another embodiment the roof section is molded so as to provide a theme based design. Themes such as Mediterranean, western or others are provided.

In a preferred embodiment the playground roof system comprises a support structure, comprising one or more legs, for holding up a roof in a playground system, and a roto-molded frame structure, having an inner perimeter, preformed with fascia and soffits. The frame of the present embodiment being releasably attachable to the support structure and—a modular roof section is attachable to the inner perimeter of the frame structure from within the frame structure. The roof section of the present invention can be installed, onto the frame, from below the frame and support structure.

The present invention further comprises a method of assembling a playground roof system, including the steps of molding one or more legs as a support structure and molding a frame having an interior perimeter. The method further includes molding one or more interchangeable roof sections and then assembling the frame and one or more legs together into an upright structure and placing the roof section within the assembled frame and leg structure and fastening the roof section to the frame and leg structure from within the interior perimeter of the frame. In one embodiment, the method includes the steps of removing the roof section from the frame and leg structure and placing and fastening a second roof section within the frame and leg structure.

A more detailed explanation of the invention is provided in the following description and claims and is illustrated in the accompanying drawings.

DETAILED DESCRIPTION OF THE ILLUSTRATIVE EMBODIMENT

Figure 1:
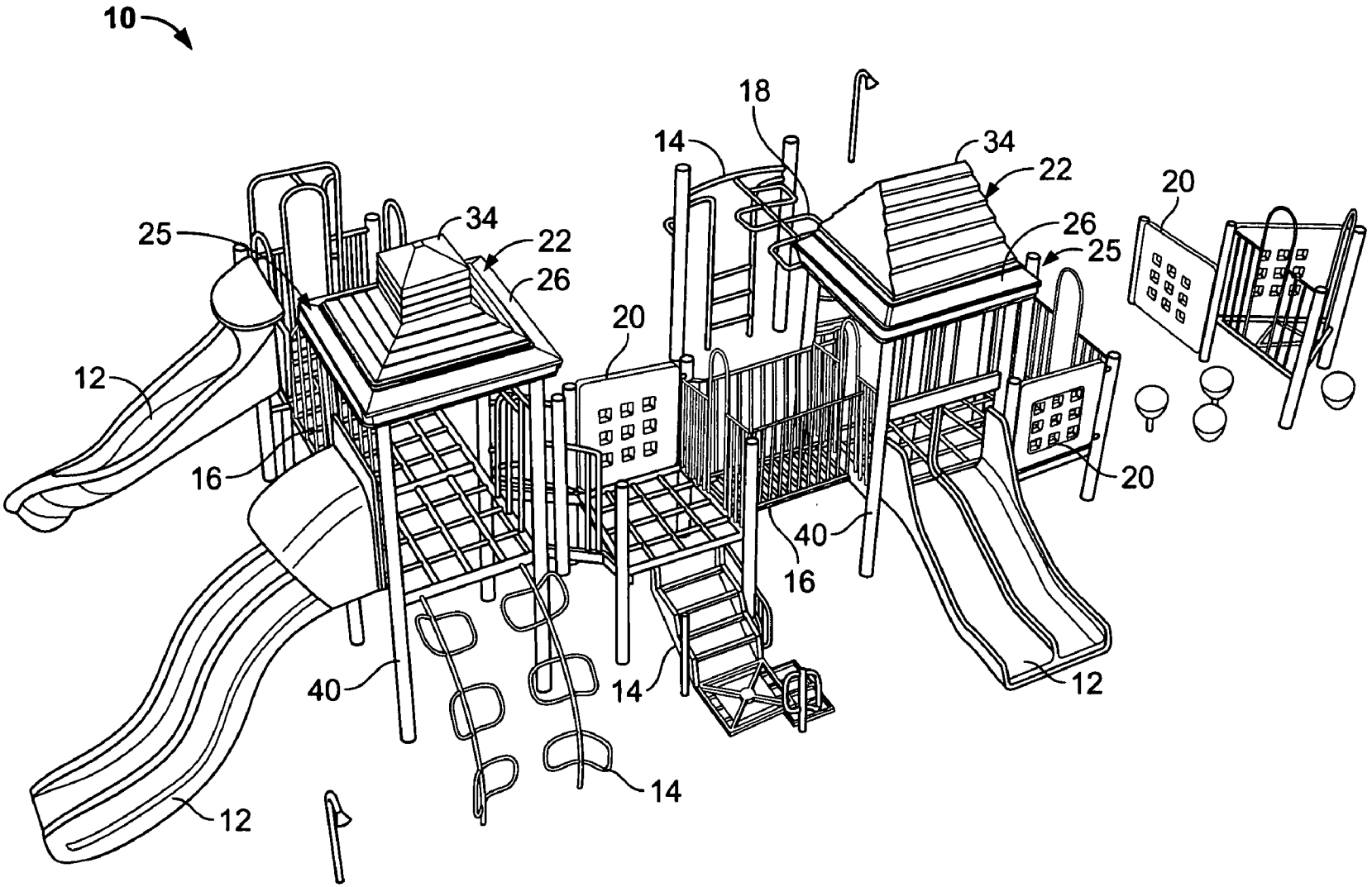
FIG. 1 is a perspective view of a playground having roofing structures made with the teachings of the present invention.

While the present invention is susceptible of embodiment in various forms, there is shown in the drawings a number of presently preferred embodiments that are discussed in greater detail hereafter. It should be understood that the present disclosure is to be considered as an exemplification of the present invention, and is not intended to limit the invention to the specific embodiments illustrated. It should be further understood that the title of this section of this application ("Detailed Description of the Illustrative Embodiment")

relates to a requirement of the United States Patent Office, and should not be found to limit the subject matter disclosed herein.

Referring to the drawings, FIG. 1 shows a typical playground system 10, such as those manufactured by Game-Time, a division of Playcore Wisconsin, Inc., of Janesville, Wis., assignee of the present invention. System 10 includes such play equipment as slides 12, climbing equipment 14, elevated walkways 16, monkey bars 18, play panels 20 and roofing structures 22.

Figure 8:
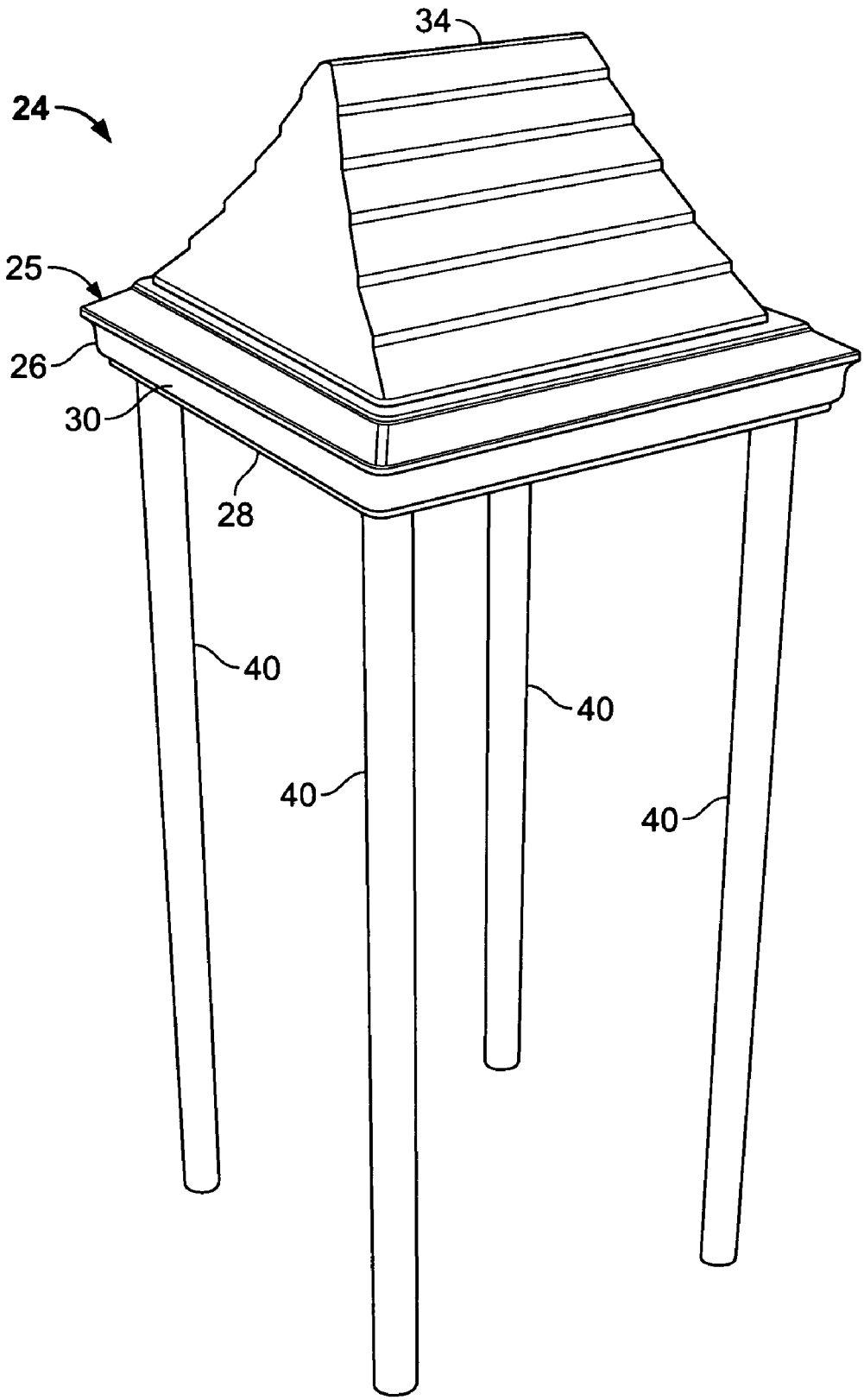
FIG. 8 is a perspective view of a roofing structure made in accordance with the teachings of the present invention.

Roof structures 22 of the present invention are uniquely designed to permit the user to easily provide shelter and thematic development for a playground system 10. For example, certain roofing shapes can evoke different play and themes. A pagoda roof evokes the far east, a Spanish tile roof can evoke the Mediterranean seaside, a cupola roof, such as that shown in FIG. 8, can evoke a barn or plantation setting, for example.

Figure 2:
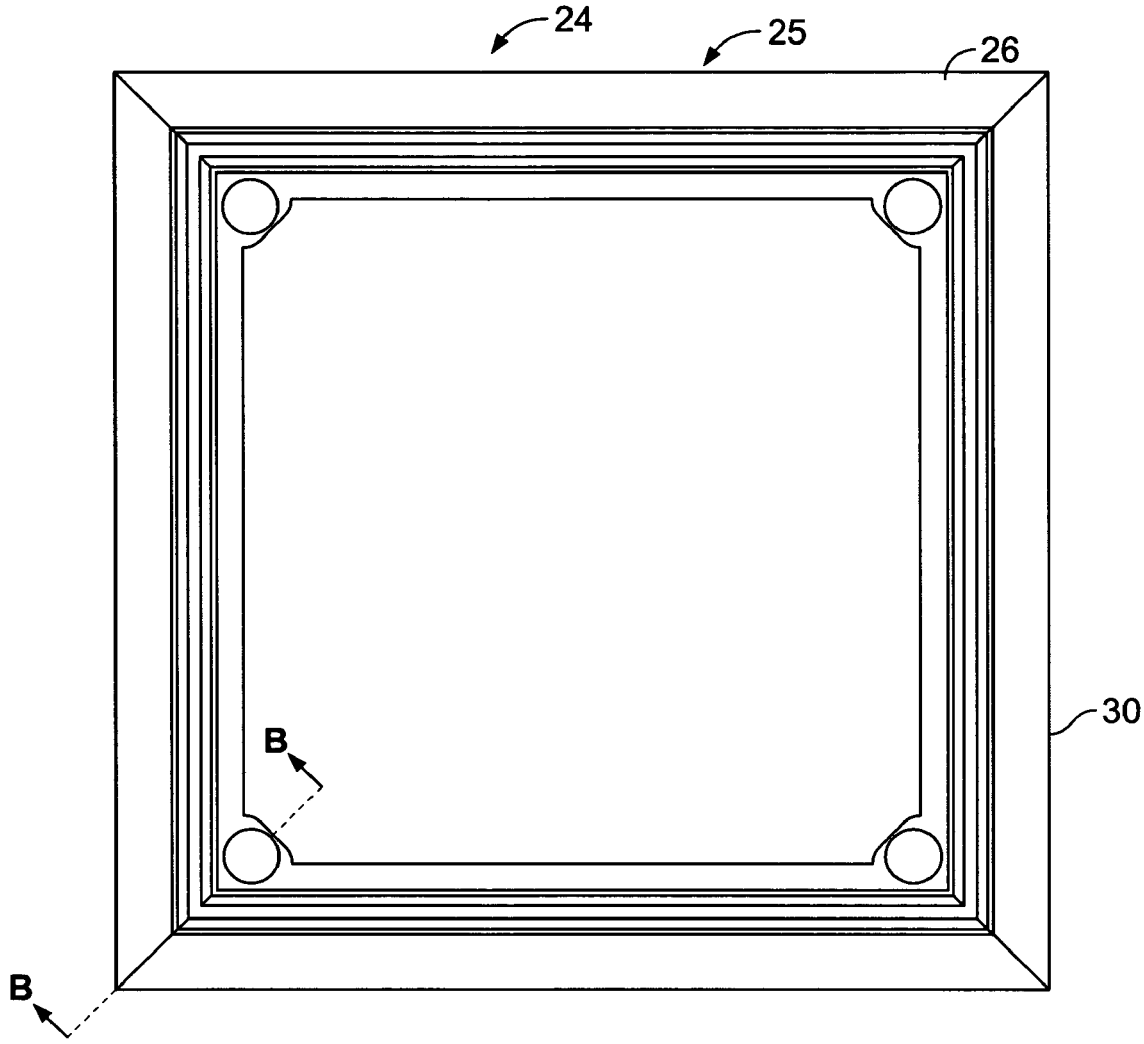
FIG. 2 is a top plan view of the roof support structure of the present invention.
Figure 3:
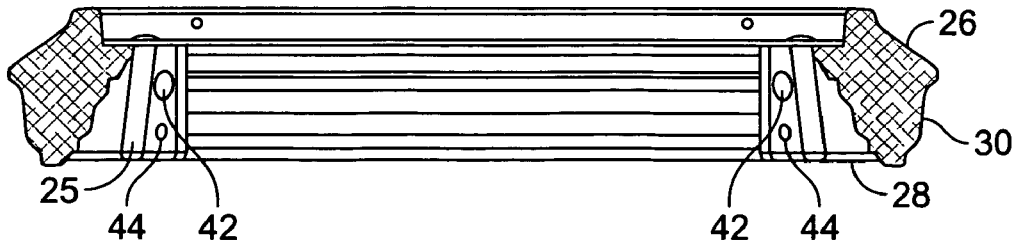
FIG. 3 is a cross sectional view of the roof support structure of FIG. 2, taken along the plane of lines A-A of FIG. 5.

Referring to FIGS. 2 and 3, a substructure 24 of the roofing structure 22 of the present invention is shown. Substructure 24 is, in a preferred embodiment, a roto-molded frame 25, molded to give the impression of being a combination of gutters 26, soffits 28 and fascia 30 of a roof. Roto-molding for frame 25 and other parts used in the roofing system of the present invention can be done in a process explained in U.S. Pat. No. 5,324,472, assigned to Playcore Wisconsin, Inc., assignee of the present invention. The above noted U.S. Patent is incorporated herein as if set forth in its entirety here. It will be understood by persons having ordinary skill in the art, that other methods of manufacturing the components of the roof and playground system 10, of the present invention can be utilized without departing from the novel scope of the present invention.

Figure 5:
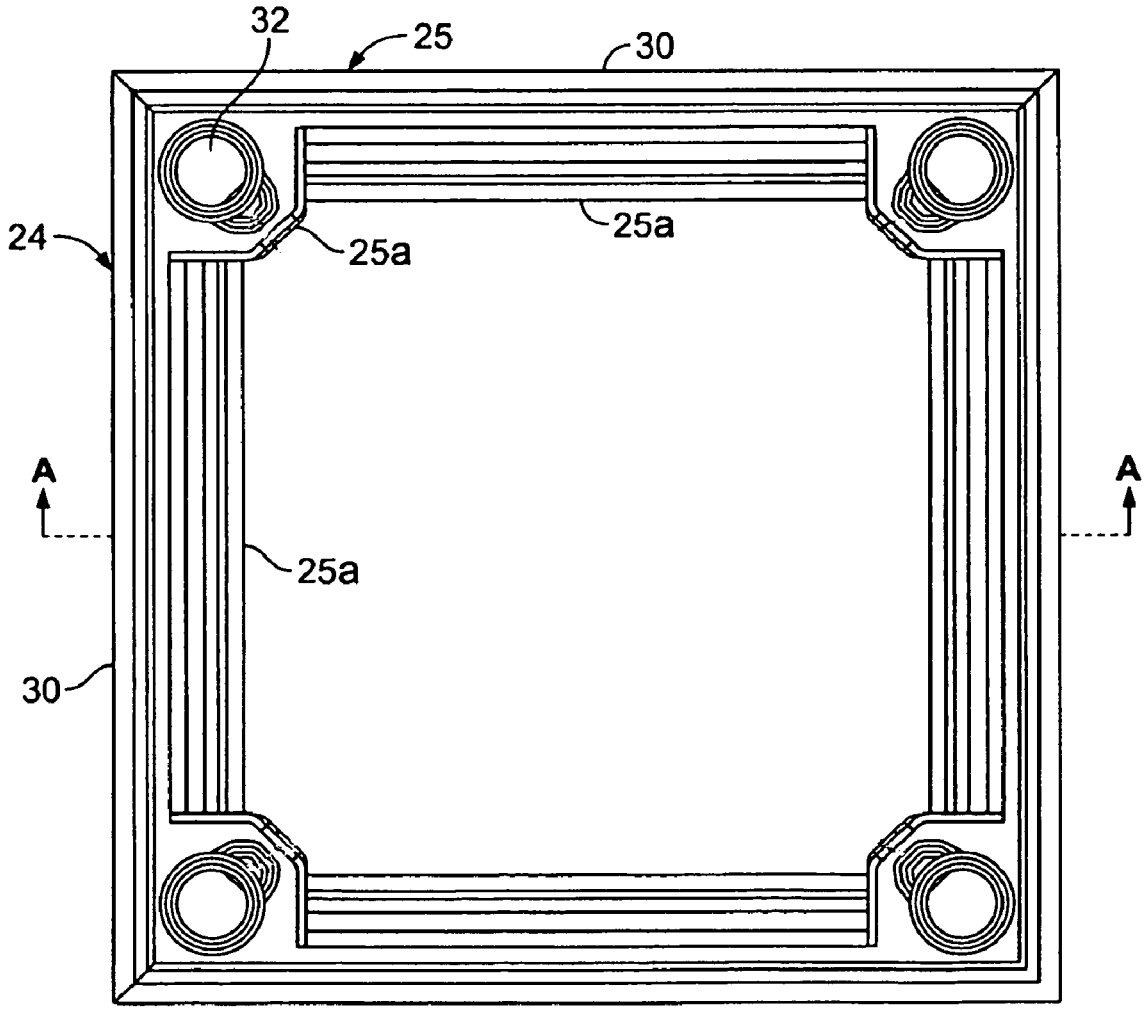
FIG. 5 is a bottom view of the roof support structure of FIG. 2.
Figure 6:
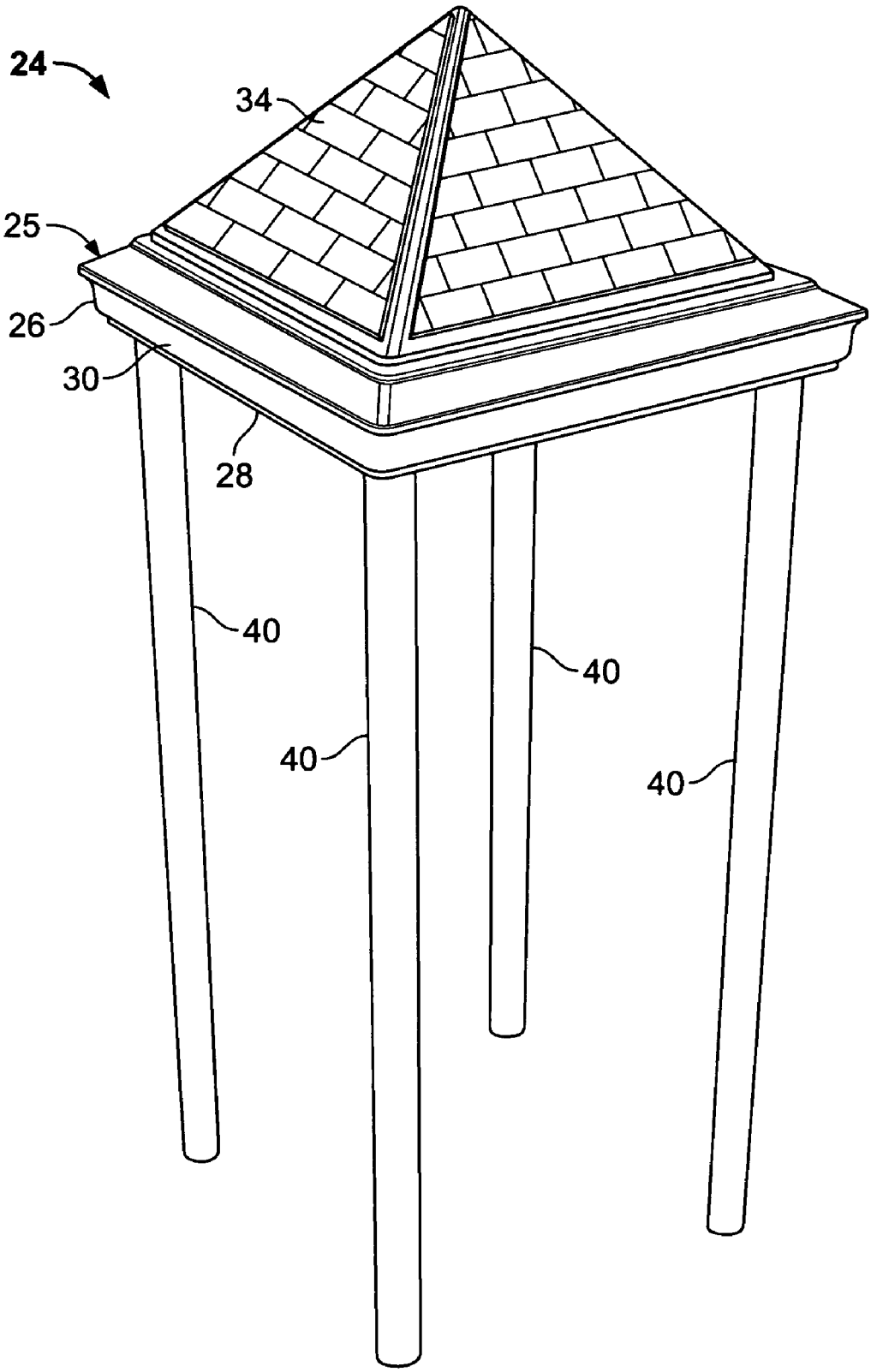
FIG. 6 is a perspective view of a roofing structure made in accordance with the teachings of the present invention.
Figure 7:
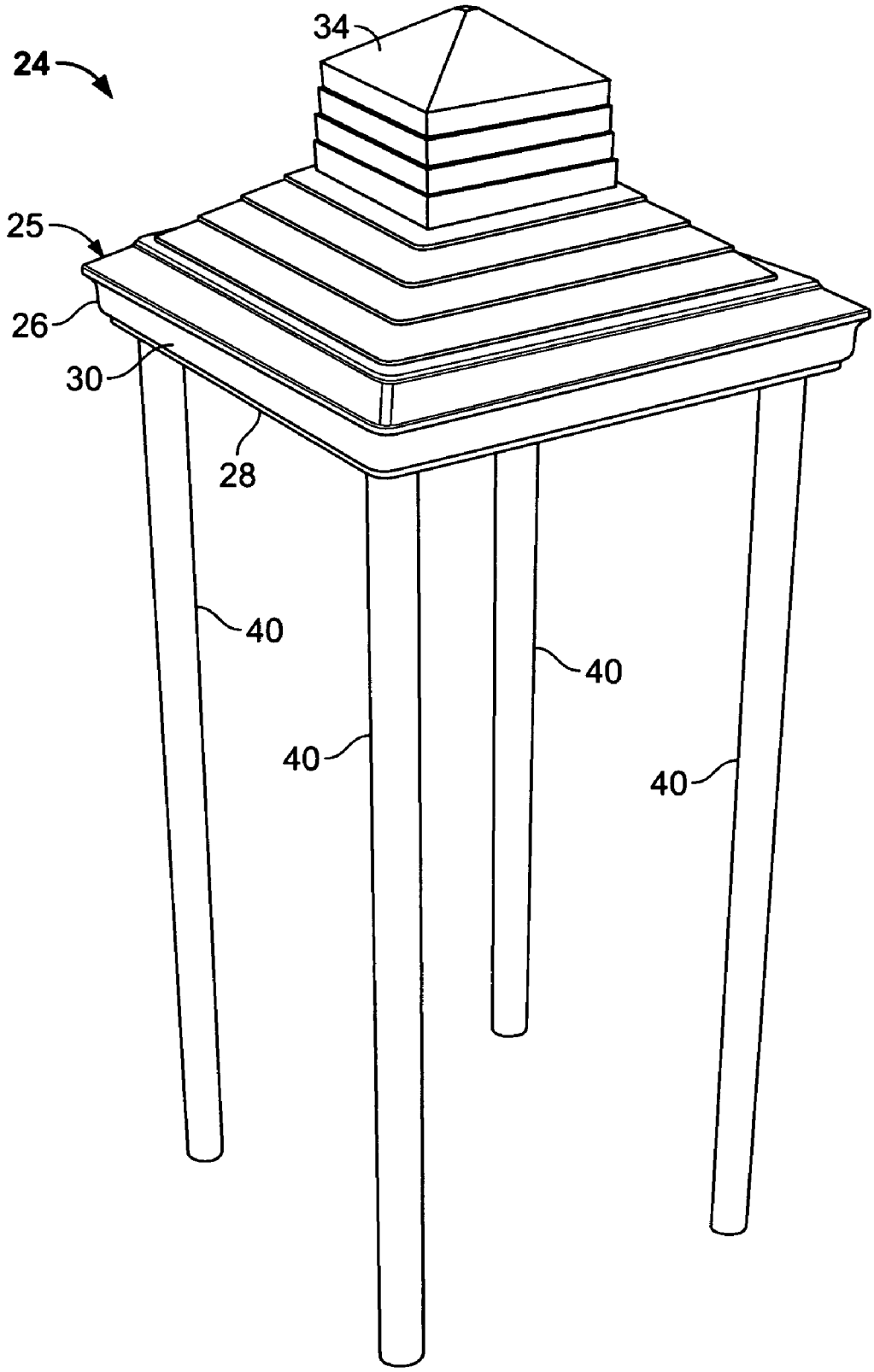
FIG. 7 is a perspective view of a roofing structure made in accordance with the teachings of the present invention.

Frame 25, further, has openings 32, shown in FIG. 5, into which structural support members, not shown, can be inserted to support the roof above a playground system 10. The support of frame 25 and a roof 34, is the subject of Applicant's co-pending patent application, which explains in detail the manner and method of installing such a roof system in or about a playground. Frame 25 further defines openings 36 for the attachment of a roof 34 from within and beneath frame 25. In a preferred embodiment, opening 36 contains threading for use with a fastener. It will be understood that various means to attach roof 34 to frame 25 can be utilized without departing from the novel scope of the present invention.

Figure 4:
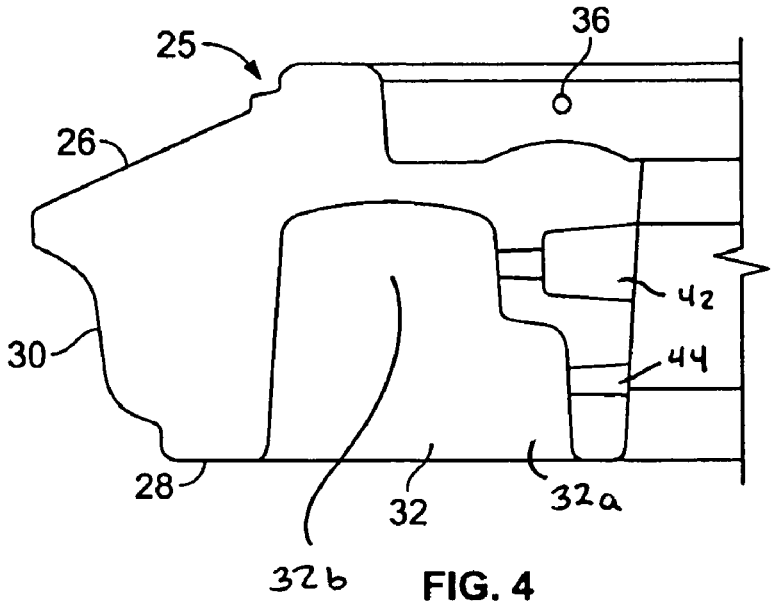
FIG. 4 is another cross sectional view of the roof support structure of FIG. 2, taken along the plane of lines B-B of FIG. 2.

As shown in FIGS. 4 and 5, openings 32 are made so that a support structure, such as legs 40 shown in FIGS. 6-8 and FIG. 1, can be inserted within frame 25 to support the roofing structure 22 of the present invention upright. FIG. 4 clearly shows frame 25 in cross section, showing soffit 28, fascia 30 and gutters 26, as well as one opening 36, into which connections for roof 34 are made. It can be clearly seen, from FIGS. 3 and 4, that roof 34 can be attached to frame 25 from within the inner diameter of frame 25. Further, the connection points, openings 36, are relatively low within the roofing structure to permit easy attachment.

In the construction of a roofing structure 22, a molded frame 25 is connected to legs 40 from within the frame 25 by placing the ends of each of four legs within openings 32 and attaching them with screws, or other fastening means, through openings 42 and 44 in the interior perimeter 25*a* of frame 25. Once frame 25 is attached to legs 40 and the structure is placed upright, a roof 34, of any variety provided can be quickly installed by placing the roof 34 on top of frame 25 and bolting, screwing or otherwise fastening the roof to the frame 25, from within the frame perimeter 25*a*. When desired, roof 34 can be removed and a different type of roof 34 can be attached to frame 25, so as to effect a different type of theme.

Although an illustrative embodiment of the invention has been shown and described, it is to be understood that various modifications and substitutions may be made by those skilled in the art without departing from the novel spirit and scope of the invention.

What is claimed is:

1. A playground roof system comprising:

a support structure for holding up a roof in a playground system;

a unitary, one-piece frame structure, having openings and an inner perimeter, the frame structure being attachable to the support structure with the support structure extending into the openings and with the inner perimeter defining a void internal to the inner perimeter; and, a unitary, one-piece modular roof section attachable, to the inner perimeter of the frame structure, from within and internal to the frame structure, the roof section being installed onto the frame from below and through the inner perimeter of the frame and support structure, with the roof section having a configuration cooperating with the inner perimeter of the frame and allowing the roof section to be directed through the inner perimeter of the frame from below before installing onto the frame, wherein the roof section extends over the support structure when installed.

2. The playground roof system of claim 1, wherein the support structure comprises one or more legs extending into the openings.

3. The playground roof system of claim 1, wherein the frame structure surrounds the void and comprises the design of a soffit, fascia and gutters of a roof with the gutter surrounding the modular roof section, and further comprising openings in the interior perimeter of the frame accessible from below to provide access for fasteners extending therethrough connecting the roof to the frame.

4. The playground roof system of claim 1, wherein the modular roof section has a first theme and is removably attached such that it is placed and then removed through the inner perimeter so that a second modular roof of a second theme different from the first theme is installed through and within the frame.

5. The playground roof system of claim 1, wherein the modular roof section is molded so as to provide a theme based design.

6. The playground roof system of claim 5, wherein the theme of the roof is Mediterranean.

7. The playground roof system of claim 5, wherein the theme of the roof is a farm-like cupola roof.

8. A playground roof system comprising:

a support structure, comprising one or more legs, for holding up a roof in a playground system;

a unitary, one-piece roto-molded frame structure, having an inner perimeter about a void, preformed with fascia and soffits, the frame being releasably attachable to the support structure; and, a unitary, one-piece modular roof section attachable to the inner perimeter of the frame structure from within, through and internal to the frame structure, such that the roof section is installed onto the frame from below the frame and support structure to cover the void, with the modular roof section passing through the inner perimeter onto the frame structure, and with the modular roof section extending over the one or more legs.

9. The playground roof system of claim 8, wherein the theme of the roof is Mediterranean.

10. The playground roof system of claim 8, wherein the elements of the roofing system are made of plastic.

11. The playground roof system of claim 8, wherein the roofing system is an element of a play system.

12. A method of assembling a playground roof system, including the steps of:

molding one or more legs;

molding a unitary, one-piece frame having an inner perimeter;

molding one or more unitary, one-piece roof sections having a first theme and providing as a roof;

assembling the frame and one or more legs together into an upright structure; and placing the roof within the assembled frame and leg structure by directing the roof through the inner perimeter of the frame from below to pass through the inner perimeter and then independently fastening the roof to the frame, and the frame to the leg structure, from internal to and within the inner perimeter of the frame, wherein the roof extends over the legs when installed.

13. The method of assembling a playground roof system of claim 12, further including the steps of removing the roof from the frame and leg structure through the inner perimeter and placing and fastening a second roof section having a second theme within the frame and leg structure wherein the second theme is not the first theme.

* * * * *